US005558019A

United States Patent [19]

Kawai et al.

[11] Patent Number: 5,558,019

[45] Date of Patent: Sep. 24, 1996

[54] ROTARY PRINTING MACHINE

[75] Inventors: Muneaki Kawai; Koichi Oyama, both of Tokyo, Japan

[73] Assignee: Riso Kagaku Corporation, Tokyo, Japan

[21] Appl. No.: 560,957

[22] Filed: Nov. 20, 1995

[30] Foreign Application Priority Data

Nov. 21, 1994 [JP] Japan ..... 6-286737
Feb. 17, 1995 [JP] Japan ..... 7-029640

[51] Int. Cl.[6] ..... B41F 15/00; B41F 15/34

[52] U.S. Cl. ..... 101/116; 101/128.4; 101/477

[58] Field of Search ..... 101/114, 115, 101/116, 128.4, 129, 128.1, 117, 118, 477

[56] References Cited

U.S. PATENT DOCUMENTS 5,323,699 6/1994 Motoe et al. ..... 101/114
5,402,727 4/1995 Matsuo et al. ..... 101/477 X
5,443,556 8/1995 Hasegawa et al. ..... 101/116

FOREIGN PATENT DOCUMENTS 2-82566 6/1990 Japan .

*Primary Examiner*—J. Reed Fisher
*Attorney, Agent, or Firm*—Sughrue, Mion, Zinn, Macpeak & Seas

[57] ABSTRACT

A rotary stencil printing machine includes: stencil making section for processing the stencil sheet to obtain a printing stencil; a printing drum having an outer cylindrical surface and a clamping member which clamps the front end portion of the stencil sheet thus processed by the stencil making section, the printing drum being turned with the front end portion of the stencil sheet clamped with the clamping member to wind the stencil sheet on the outer cylindrical surface thereof; a conveyer for conveying the stencil sheet, which has been processed by the stencil making section, towards the drum; a movable guide which is movable between a standby position and a holding position which are spaced away from each other in a direction perpendicular to the surface of the stencil sheet located between the stencil making section and the drum, the guide moving from the standby position to the holding position, for lengthening a stencil conveying path between the stencil forming section and the clamping member, wherein the guide receives the force by its own weight towards the holding position; and a pin for holding the guide at the standby position against its own weight, and for, after the stencil sheet is held on the side of the drum rather than on the side of the guide, releasing the guide.

8 Claims, 10 Drawing Sheets

ROTARY PRINTING MACHINE

BACKGROUND OF THE INVENTION

1. Field of the Invention

This invention relates to a rotary stencil printing machine in which, in a series of sequential operations, a stencil sheet is wound on a printing drum while being thermally perforated by a thermal head according to a given original.

2. Description of Related Art

In the case where, in a series of sequential operations, e stencil sheet is thermally perforated by a thermal head to obtain a printing stencil, end wound on a printing drum, the following two methods are employed: In one of the methods, the stencil sheet is thermally perforated by a stencil making section, to obtain a printing stencil, and is then wound on the printing drum. In the other method, after the front end of the stencil sheet which is thermally perforated to obtain a printing stencil is locked to the printing drum with clamping means, only the stencil making operation is continued so that the part of the stencil sheet which is thermally perforated as was described above is temporarily held in a holding chamber. After the making of the printing stencil, the printing drum is turned to wind the stencil on it in one action.

The former method, however, suffers from a problem that the speed of conveyance of the stencil sheet in the stencil-making section must be equal to the speed at which the stencil sheet is wound on the printing the drum; otherwise the stencil sheet which is being thermally perforated by the stencil-making section is pulled, so that the picture formed on it with the thermal head may be deformed or broken, or the stencil sheet forms creases while being wound on the printing drum.

The later method has been proposed by Japanese Patent Application Laid-open No. Hei. 2-82566. The method is disadvantageous in that the direction in which the stencil sheet is slackened when conveyed out of the stencil-making section is not constant; that is, the stencil sheet, being bent irregularly, is liable to be broken. In addition, it has no means for regulating or absorbing the slackening of the stencil sheet, and therefore when the stencil sheet is wound on the printing drum, it is liable to be creased or damaged. Furthermore, the holding chamber, which adapted to temporarily hold the part of the stencil sheet which is thermally processed during the stencil making operation, must be large enough to hold even a long printing stencil. This requirement obstructs the miniaturization of the printing machine.

SUMMARY OF THE INVENTION

Accordingly, an object of the invention is to provide a rotary stencil printing machine which is free from the above-described difficulties accompanying a conventional rotary stencil printing machine, and is able to form prints higher in quality than those formed by the conventional printing machine.

In order to achieve the object, according to a first aspect of the invention, there is provided a rotary stencil printing machine in which a printing stencil is obtained from a stencil sheet, the rotary stencil printing machine comprising; stencil making means for processing the stencil sheet to obtain the printing stencil; a printing drum having an outer cylindrical surface and clamping means which clamps the front end portion of the stencil sheet thus processed by the stencil making means, the printing drum being turned with the front end portion of the stencil sheet clamped with the clamping means to wind the stencil sheet on the outer cylindrical surface thereof; conveying means for conveying the stencil sheet, which has been processed by the stencil making means, towards the printing drum; movable guide means which is movable between a standby position and a holding position which are spaced away from each other in a direction perpendicular to the surface of the stencil sheet located between the stencil making means and the printing drum, the movable guide means moving from the standby position to the holding position, for lengthening a stencil conveying path between the stencil making means and the clamping means; urging means for urging the movable guide means towards the holding position; end holding means for holding the movable guide means at the standby position against the urging means, and for, after the stencil sheet is held on the side of the printing drum rather than on the side of the movable guide means, releasing the movable guide means.

According to a second aspect of the invention, there is provided a rotary stencil printing machine of the first aspect, wherein the movable guide means has guide surfaces for both sides of the stencil sheet, to cause the stencil sheet to follow the movement of the movable guide means between the standby position and the holding position.

According to a third aspect of the invention, there is provided a rotary stencil printing machine of the first aspect, wherein the urging of the movable guide means by the urging means attributes to the weight of the movable guide means.

According to a fourth aspect of the invention, there is provided a rotary stencil printing machine of the first aspect, further comprising; returning means for, after the stencil sheet is wound on the printing drum, returning the movable guide means against the urging means.

According to a fifth aspect of the invention, there is provided a rotary stencil printing machine of the fourth aspect, further comprising: original reading means for reading an original to be printed; and a reading motor which, when the original is read with the original reading means, is rotated in one direction to move the original reading means and the original with respect to each other, and, after the stencil sheet is wound on the printing drum, is rotated in the opposite direction through a predetermined angle, wherein the returning means operating to return the movable guide means to the standby position in association with the rotation of the reading motor in the opposite direction.

According to a sixth aspect of the invention, there is provided a rotary stencil printing machine of the first aspect, wherein the holding means comprises: a link which has an engaging portion which is engaged with the movable guide means, and is swingably supported on a machine frame; and an electro-magnetic solenoid for controlling the swinging of the link.

According to a seventh aspect of the invention, there is provided a rotary stencil printing machine of the first aspect, wherein, while a stencil making operation is being carried out the printing drum is turned in plural steps having intermittent pausing to wind the stencil sheet on the printing drum.

According to an eighth aspect of the invention, there is provided a rotary stencil printing machine of the first aspect, further comprising: damping means which, at least when the movable guide means is initially moved from the standby position to the holding position, resists the movable guide means to decrease the force of movement of the movable guide means which is urged by the urging means.

In the rotary stencil printing machine of the present invention, the stencil sheet is thermally perforated by a thermal head while being continuously forwarded to the thermal head by the feed roller. The discharge rollers provided downstream of the feed roller are stopped after the front end of the stencil sheet is locked to the printing drum with the clamp.

As a result, the part of the stencil sheet which has been thermally perforated by, the thermal head is gradually held slackened between the feed roller and the discharge rollers. In this case, the movable guide means, being released from holding means, is gradually moved from the standby position. Therefore, the stencil sheet thus slackened is gently guided into the holding chamber without adversely affecting the picture which is formed on it according to the given original by the stencil making section, thus being correctly held in the holding chamber.

Thereafter, the printing drum is turned in several steps, while being intermittently paused. During the pause period, the part of the stencil sheet which has been thermally perforated by the stencil making section is pulled out of the storing chamber so as to be wound on the printing drum. In this operation, the stencil is suitably stretched by movable guide means, and therefore the stencil sheet is wound on the printing drum without forming creases.

DETAILED DESCRIPTION OF THE PREFERRED EMBODIMENTS

A rotary stencil printing machine, which constitutes a preferred embodiment of the invention, will be described with reference to the accompanying drawings.

Figure 1:
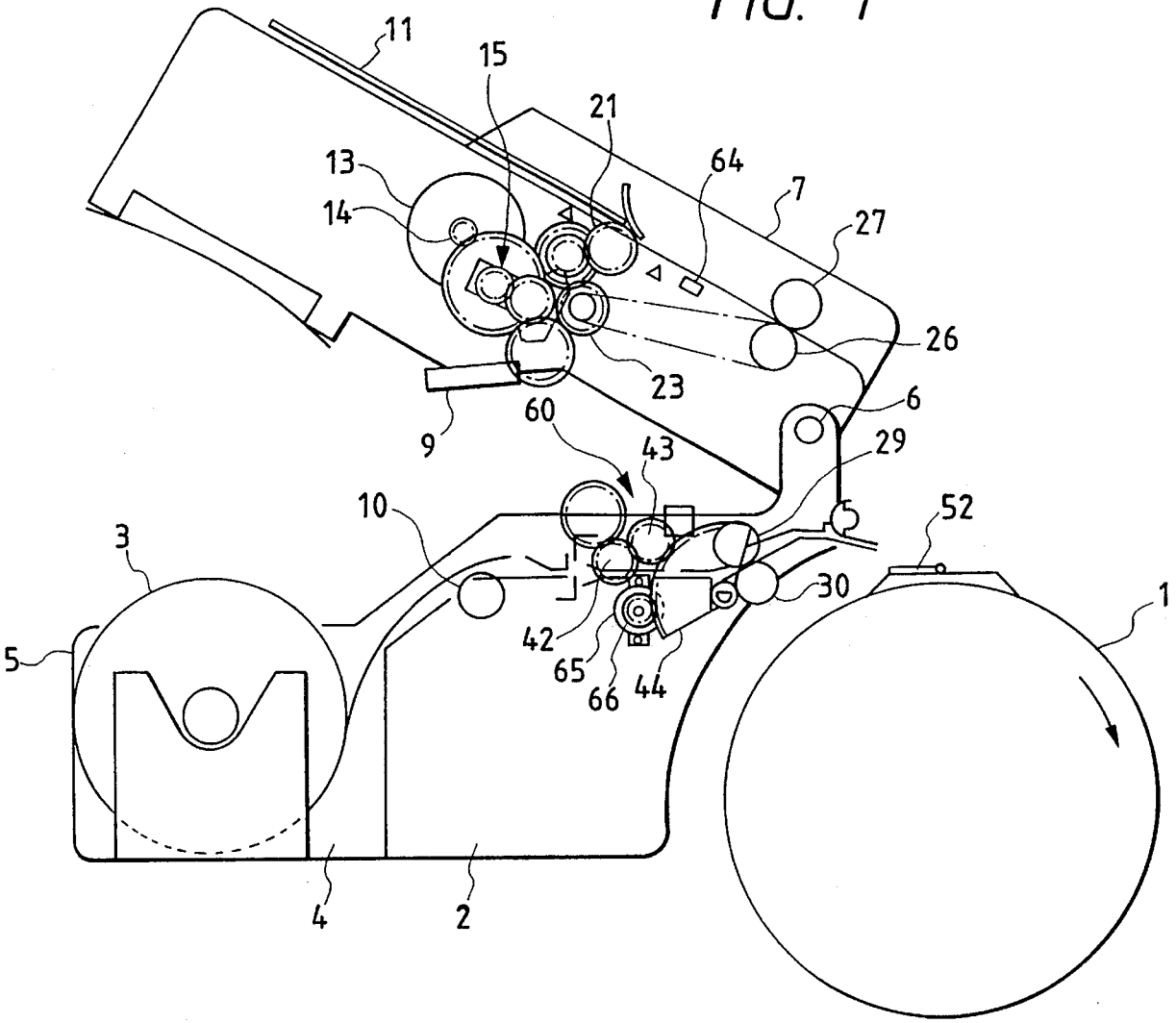
FIG. 1 is a sectional side view of a rotary printing machine with its upper unit opened.
Figure 2:
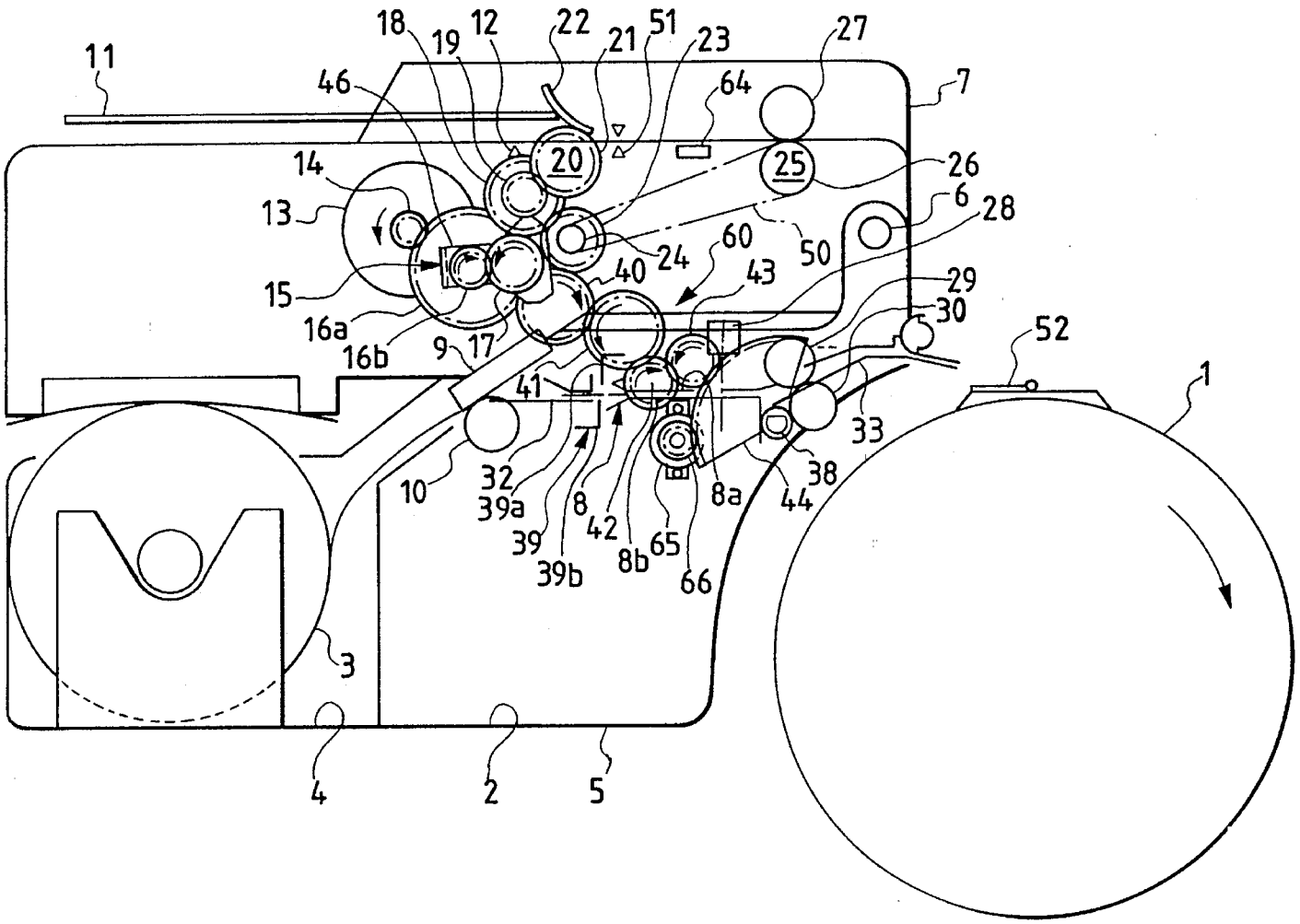
FIG. 2 is a sectional side view of the rotary printing machine with the upper unit closed.

FIG. 1 is a sectional side view showing a stencil-making section built in the printing machine with its upper unit opened, and FIG. 2 is a sectional side view showing the stencil-making section with its upper unit closed.

The stencil-making section is arranged beside a rotary cylindrical drum 1 (hereinafter referred to as "a printing drum 1" or merely as "drum 1", when applicable). The stencil-making section includes a stencil-making lower unit 5 including a holding chamber 2, and a roll accommodating chamber 4 in which a belt-shaped stencil sheet 3 provided in the form of a roll is set; and a stencil-making upper unit 7 which is pivotable about a shaft 6 with respect to the lower unit 5 to take either an opened position as shown in FIG. 1 or a closed position as shown in FIG. 2.

The stencil-making upper unit 7 performs an original reading operation; that is, it reads a given original 11.

The stencil-making upper unit 7 includes; an original handling roller 21; an original forwarding roller 26, driven roller 27, and original reading means The stencil-making upper unit 7 further includes: a reading pulse motor 13 which may be turned not only clockwise in FIG. 1 (in the forward direction) but also counterclockwise (in the reverse direction).

Figure 5:
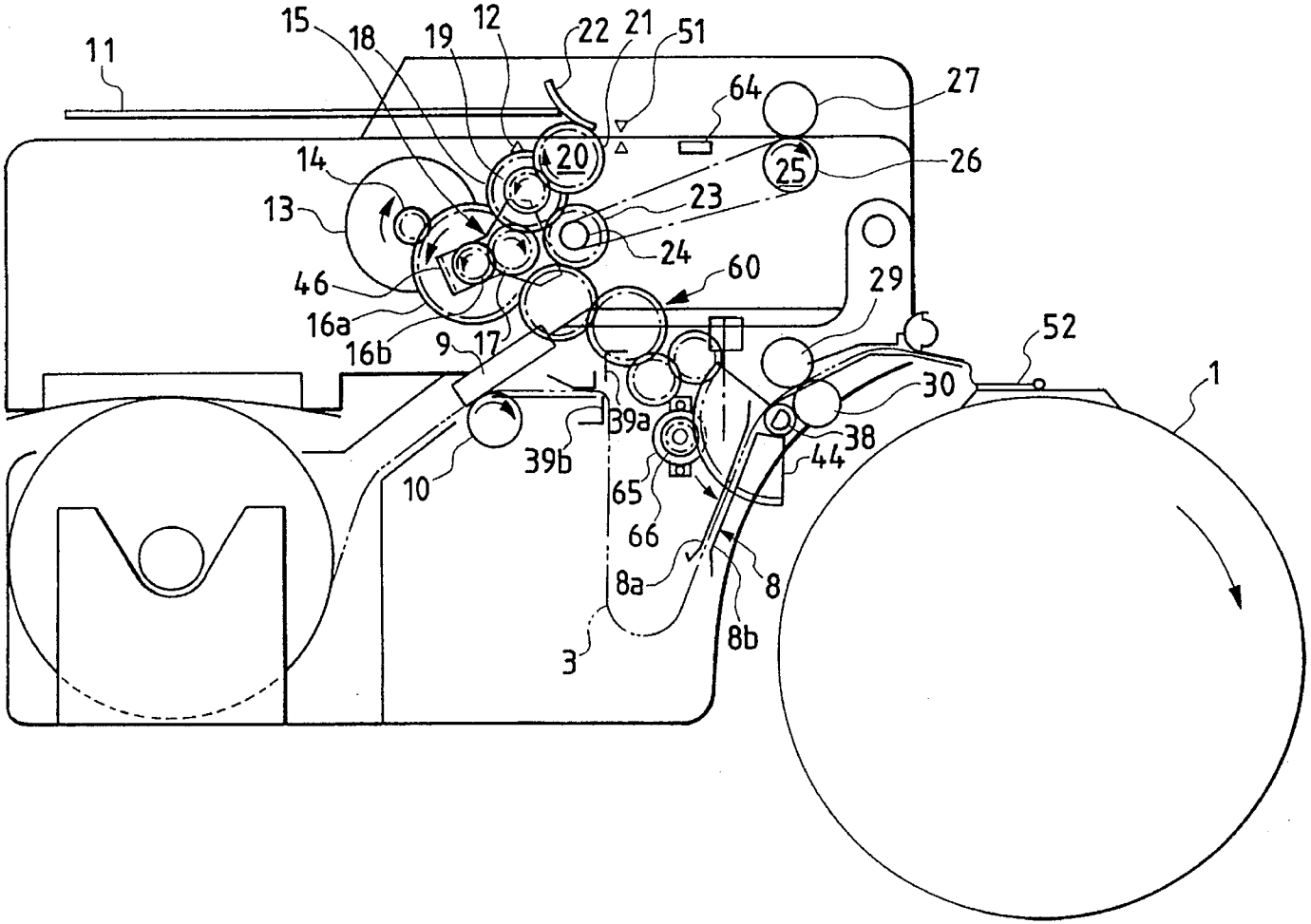
FIG. 5 is a diagram for a description of a stencil conveying operation in the rotary printing machine.

Only when the reading pulse motor 13 is turned clockwise in FIG. 5 (in the forward direction), the original handling roller 21, being coupled through gears 14 through 20 to the reading pulse motor 13, is turned clockwise, thus cooperating with an original handling board 22 to forward the original 11 to the right in FIG. 5.

Similarly as in the case of the original handling roller 21, only when the reading pulse motor 13 is turned clockwise in FIG. 5, the original forwarding roller 26 is coupled through the gears 14 through 18 and gears 23 through 25 and a timing endless belt 50 to the reading pulse motor 13, thus cooperating with the driven roller 27 to forward the original to the right in FIG. 5.

The original reading means 64 reads the original 11 while the original 11 is being forwarded by the original handling roller 21 and the original forwarding roller 26. In the above-described printing machine, the original reading means 64 is stationary, and the original 11 is moved; however, the printing machine may be so modified that the original 11 is stationary, and the original reading means 64 is movable.

The stencil-making lower unit 5 is to perform a writing operation (described later) to thermally process the stencil sheet 3 to obtain a printing stencil. The stencil-making lower unit 5 includes: a platen roller 10 serving as means for conveying the stencil sheet 3; discharge rollers 29; and a thermal head serving as writing means.

Figure 3:
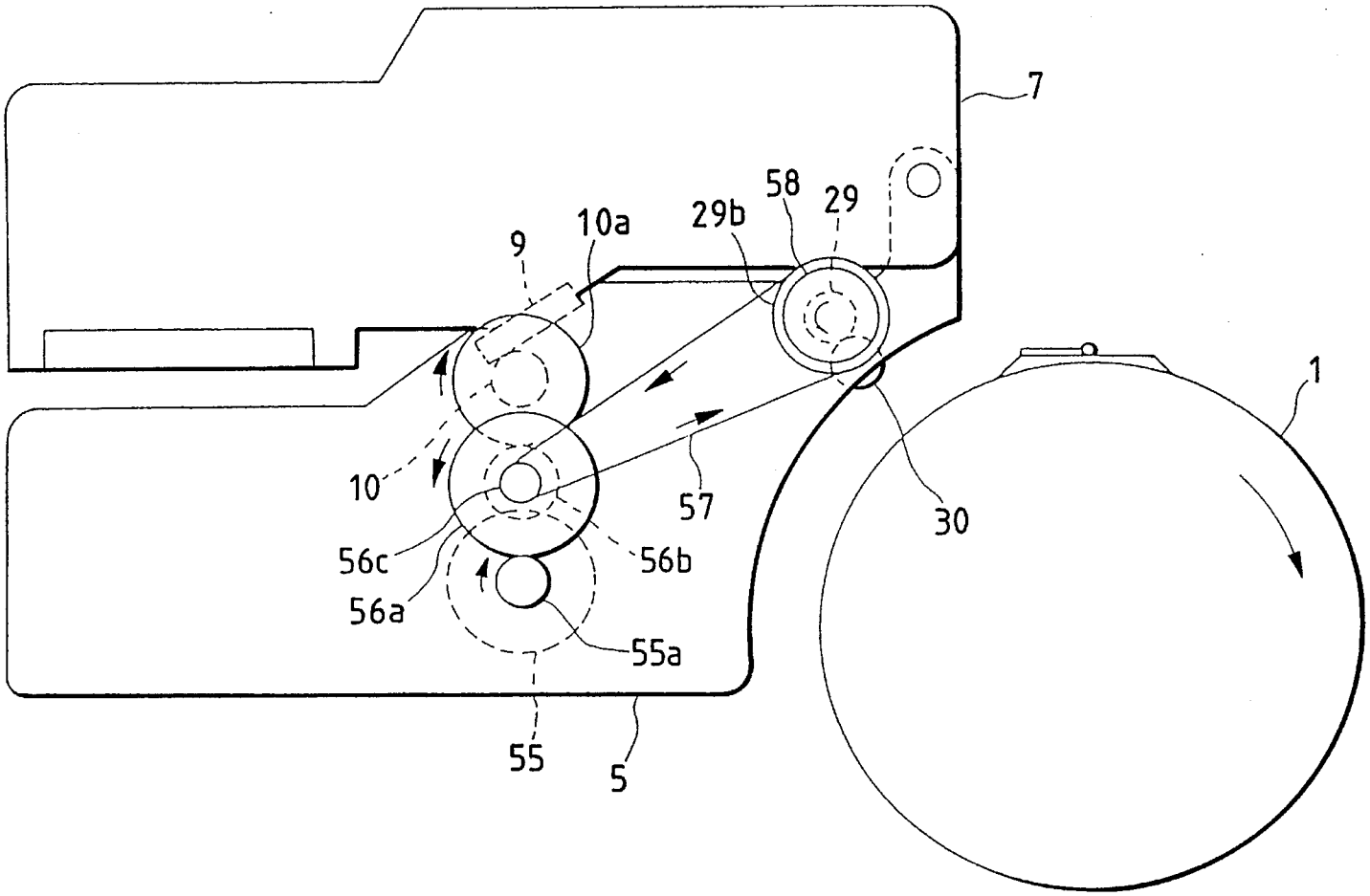
FIG. 3 is a sectional side view showing stencil conveying means.

The platen roller 10 is coupled through gears 55*a*, 56*a*, 56*b* and 10*a* to a writing pulse motor 55, so that it is turned clockwise in FIG. 3. During the rotation of the platen roller 10, the thermal head 9 is operated so that the stencil sheet 3 is thermally perforated by the thermal head according to the data which the original reading means 64 has read from the original; that is, a printing stencil is obtained.

The discharge rollers 29 are coupled through the gears 55*a* and 56*a*, a pulley 56*c*, an endless belt 57, a pulley 29*b*, and a clutch 58 to the writing pulse motor 55, so that they are turned counterclockwise in FIG. 3, thus forwarding the stencil sheet 3 towards the printing drum 1 which has been thermally perforated by the thermal head 9.

Figure 4:
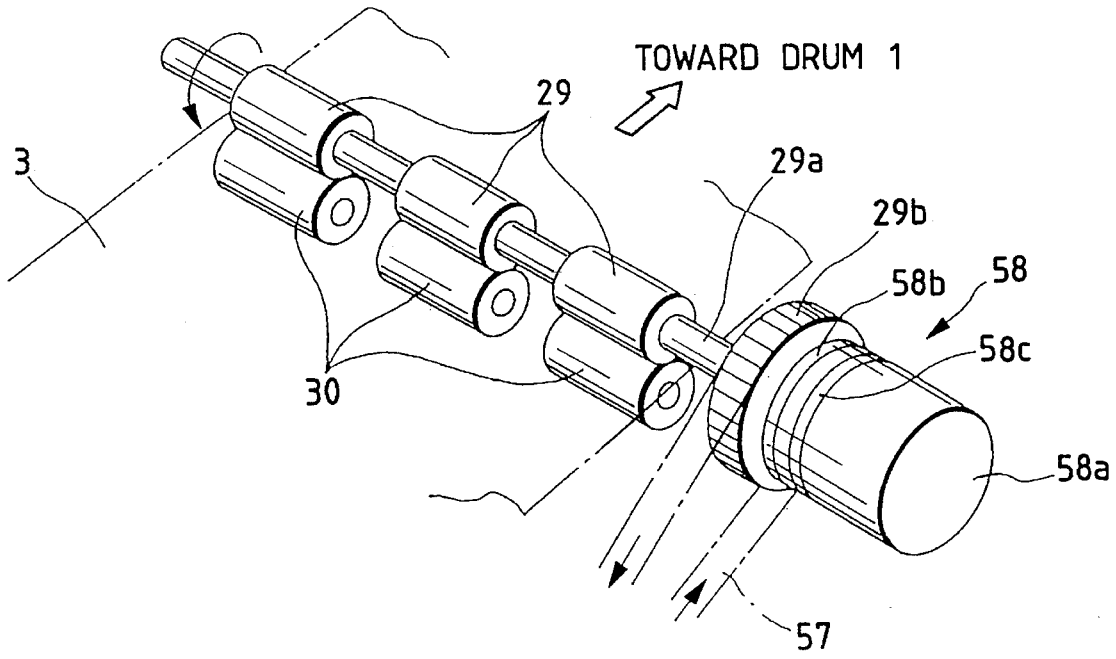
FIG. 4 is a perspective view of clutch means.

The clutch 58, as shown in FIG. 4, includes an electromagnetic solenoid 58*a*, and two clutch boards 58*b* and 58*c*. The clutch board 58*b* is slidable axially of a shaft 29*a*, and it is turned together with the pulley 29*b* being integral with the pulley 29*b*. The other clutch board 58*c* is fixedly mounted on the shaft 29*a* of the discharge rollers 29.

When the electro-magnetic solenoid 58*a* is energized (or deenergized) by control means, the clutch board 58*b* is slid on the shaft 29*a* to engage with the clutch board 58*c* (or disengage from the latter 58*c*), so that the rotation of the pulley 29*b* operating in association with the writing pulse motor 55 is transmitted to the discharge rollers 29 (or not transmitted to the rollers 29).

The discharge rollers 29 are made of an elastic material such as rubber. The driven rollers 30 are made of a metal material, and their surfaces are roughened.

The peripheral speed of the platen roller 10 is higher than that of the discharge rollers 29. Hence, as the stencil sheet 3 is conveyed, it is gradually slackened between the platen roller 10 and the discharge rollers 29.

A movable guide 8 is provided between the platen roller 10 and the discharge rollers 29. The movable guide 8 includes guides 8*a* and 8*b* provided for both sides of the stencil sheet 3. Those guides 8*a* and 8*b* define a stencil conveying path. The movable guide 8 is pivotable about a shaft 38 between a standby position as shown in PIG. 2 and a holding position as shown in FIG. 5. In the embodiment, the guides 8*a* and 8*b* are each in the form of a plate; however, the invention is not limited thereto or thereby. For instance, they may be each in the form of comb teeth.

Figure 6:
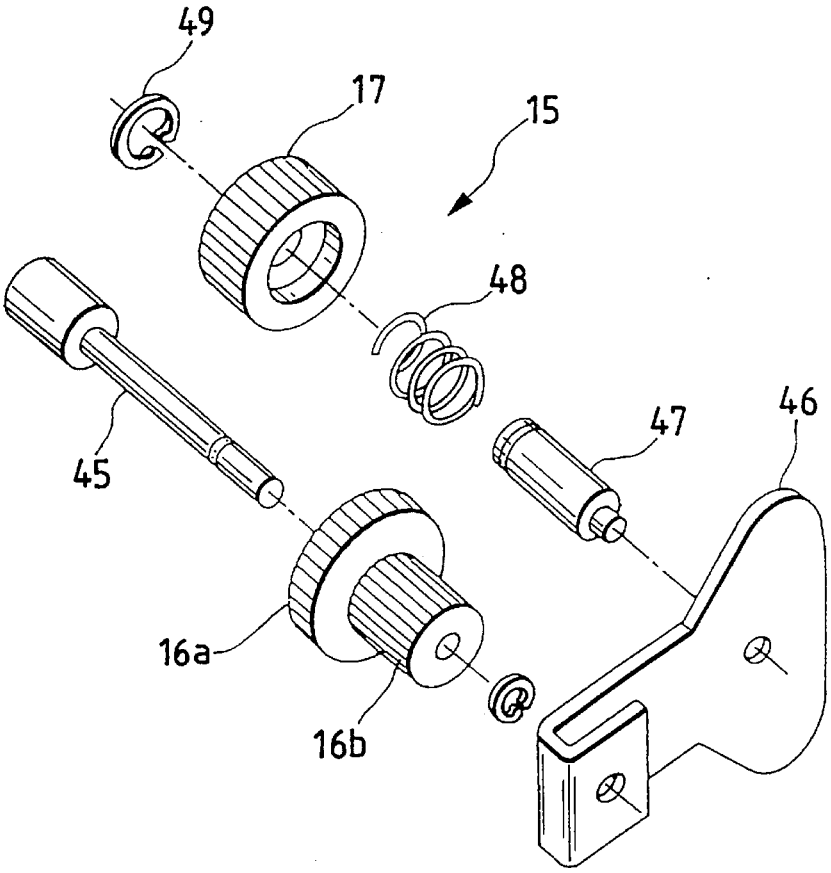
FIGS. 6 and 7 are an exploded perspective view and a sectional view, respectively, showing a switching mechanism in the rotary printing machine.
Figure 7:
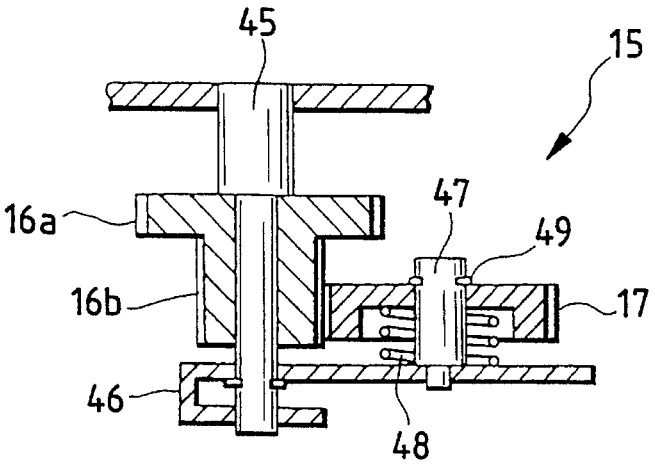

FIGS. 6 and 7 are an exploded perspective view and a sectional plan view, respectively, showing a switching mechanism 15 in the stencil-making upper unit 7.

The switching mechanism 15, separately according to the directions of rotation of the reading pulse motor 13, operates in a switching mode to apply the torque of the reading pulse motor 13 to the original handling roller 21 or to gears 41, 42 and 43 and a sector gear 44 which form returning means 60 for the movable guide 8. The switching mechanism 15 is constructed as follows:

Gears 16*a* and 16*b*, which are different in outside diameter from each other, and a switching board 46 are rotatably mounted on a shaft 45 which is fixedly mounted on the housing of the stencil-making upper unit 7. The gear 16*b* is engaged with a gear 17 which is rotatably supported through a shaft 47 by the switching board 46. A coil spring 48 is interposed between the gear 17 and the switching board 46 so that the gear 17 is pushed through its one side against a stopper 49 which is integral with the shaft 47, whereby a frictional resistance higher than the rotation frictional resistance of the switching board 46 with respect to the shaft 45 is applied to the gear 17.

Hence, when the reading pulse motor 13 is turned counterclockwise to turn the gear 16*b* clockwise, the torque of the gear 16*b* is transmitted to the gear 17. However, since the rotation of the gear 17 is resisted by the coil spring 48, the switching board 46 lower in rotational resistance than the gear 17 is turned clockwise about the shaft 45, so that the gear 17 is engaged with the gear 40 as shown in FIG. 2. When, under this condition, the rotation of the reading pulse motor is transmitted, the movable guide 8 is returned to the standby position with the aid of the returning means 60 including the gears 41, 42 and 43 and the sector gear 44.

The sector gear 44 is made integral with the movable guide 8 through the shaft 38, and it is engaged with a gear 66 of a damper 65 which forms damping means. Hence, even when the movable guide 8, being abruptly energized, is moved to the standby position or the holding position, it is slowly moved being loaded by the damper 65, so that the stencil sheet being slackened is slowly and gently drawn into the holding chamber 2.

In contrast, when the reading pulse motor 13 is rotated clockwise to turn the gear 16*b* counterclockwise, the switching board 46 is swung counterclockwise about the shaft 45. As a result, the gear 17 is engaged with the gear 18 as shown in FIG. 5, to drive the original handling roller 21 and the original forwarding roller 26.

Figure 8:
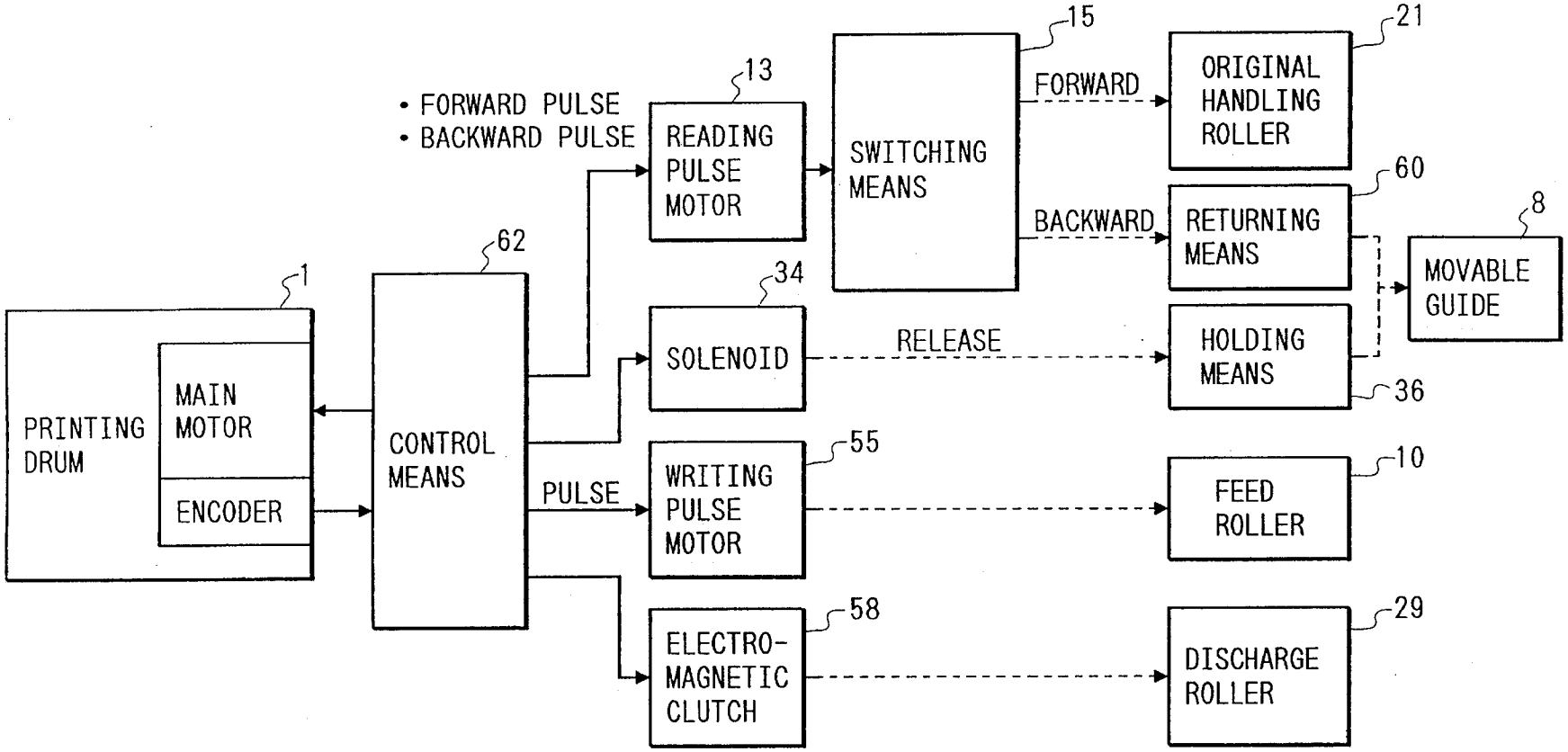
FIG. 8 is a block diagram showing control means in the rotary printing machine.

FIG. 8 is a block diagram showing an electrical circuit in the rotary printing machine of the invention.

The electrical circuit has control means 62. The control means 62 receives rotation angle data (data on the angle of rotation) of the main motor of the printing drum 1. More specifically, the main motor is provided with an encoder, and pulse counting means. A slit disk connected to the rotary shaft of the main motor is detected with an optical sensor, and an angular position is determined from the number of slits thus detected. On the other hand, the outputs of a plurality of sensors adapted to detect the original 11 and the stencil sheet 3 are applied to the control means 62.

The control means 62 operates the reading pulse motor 13 provided for reading the original 11, and the writing pulse motor 55 provided for thermally processing the stencil sheet 3 (forming a picture (data) on the stencil sheet) according to the original, in synchronization with each other.

Control is made to turn the reading pulse motor 13 in the forward direction or in the reverse direction. When the motor 13 is turned in the forward direction, the original reading operation is carried out; when it is turned in the reverse direction, the movable guide means 8 is returned with the aid of the returning means 60.

In the case where the stencil sheet which has been thermally processed in the writing operation is wound on the printing drum, the control means 62 controls the rotation of the printing drum stepwise. In addition, the control means 62 controls the timing of operation of an electro-magnetic clutch 58 to stop the discharge rolls 29, and the timing of operation of a movable guide solenoid 34 to unlock the movable guide means 8.

Figure 9:
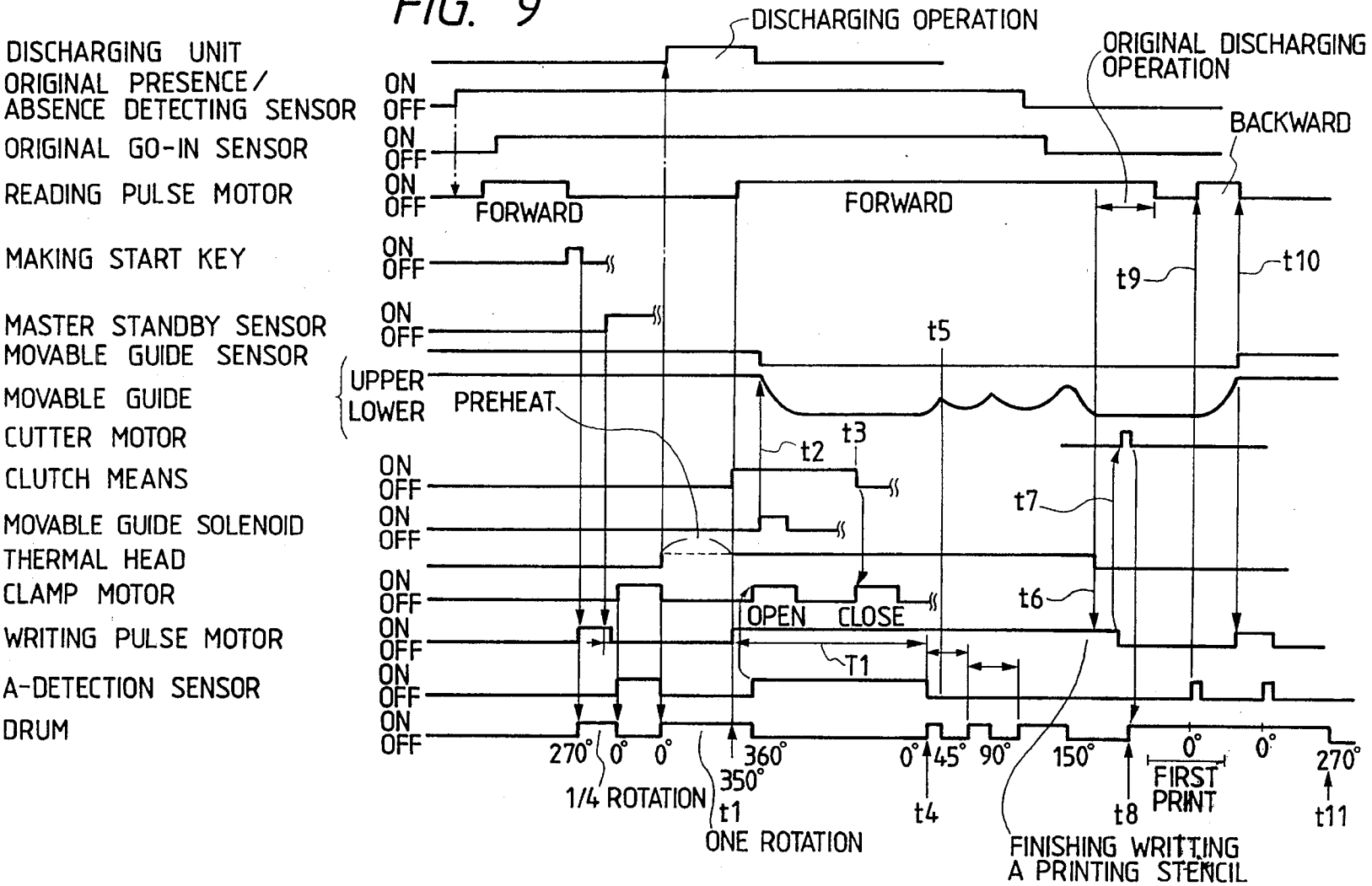
FIG. 9 is a time chart for a description of the operations of various sections in the rotary printing machine.

Now, the operation of the rotary printing machine thus organized will be described. FIG. 9 is a time chart for a description of the operations of the various sections in the rotary printing machine.

In order to operate the printing machine, as shown in FIG. I the stencil-making upper unit 7 is opened, and the stencil sheet 3 in the form of a roll is set in the roll accommodating chamber 4 in the stencil-making lower unit 5.

As the stencil-making upper unit 7 is opened, a shutter (not shown) is moved in the stencil conveying path defined by the upper and lower guides 8*a* and 8*b* of the movable guide means 8, to close the stencil conveying path.

Under this condition, the stencil sheet 3 is unwound from the roll, and inserted into the stencil conveying path until its front end abuts against the shutter.

When the stencil-making upper unit 7 is closed as shown in FIG. 2, the shutter (not shown) is retracted away from the stencil conveying path, and the thermal head 9 is pushed through the stencil sheet 3 against the platen roller 10.

When, as shown in FIG. 5, the original 11 is placed on an original presence/absence detecting sensor 12, soon the reading pulse motor 13 is rotated clockwise.

The rotation of the reading pulse motor 13 is transmitted through the gears 14 through 20 to the original handling roller 21 to turn the latter clockwise, so that the original 11 is moved to the right in FIG. 5.

When the front end of the original 11 reaches an original go-in sensor 51, the reading pulse motor 13 is stopped. Thus, the original 11 is placed in standby state; that is, it is held between the original handling roller 21 and the original handling plate 22 until the stencil making start key is operated to provide a stencil making start signal.

When the stencil making start key is operated, a stencil discharging device (not shown) is operated to discharge the printing stencil used in the previous printing operation.

In the stencil discharging operation, the main motor is driven to turn the printing drum 1 clockwise thereby to remove the used printing stencil from the printing drum 1, and the printing stencil thus removed is discarded into a used-printing-stencil accommodating box (not shown).

Immediately when the main motor is driven, the writing pulse motor 55 (cf. FIG. 3) is driven. The rotation of the pulse motor 55 is transmitted through the gears 55*a*, 56*a*, 56*b* and 10*a* to the platen roller 10 to turn the latter 10 clockwise, so that the stencil sheet 3 is moved to the right in FIG. 2.

Thereafter, the front end of the stencil sheet 3 is detected by a master standby sensor 28, and then the platen roller 10 is stopped. Thus, the stencil sheet 3 is stopped at a position which is slightly ahead of the aforementioned shutter.

When, after the stencil discharging operation is started, the printing drum 1 is turned to an angular position which is slightly before the angular position where the printing drum 1 is to be stopped, the reading operation is started that is, the original 11 is read by the original reading means 64 (the time instant t1 in FIG. 9).

In synchronization with this operation, the writing operation (the Stencil making operation) is started; that is, the stencil sheet is thermally perforated the stencil-making means 9.

When the printing drum 1 makes one revolution to the angular position (shown in FIG. 2) where the stencil is wound on the drum; that is, when the stencil discharging operation is accomplished, the drum 1 is stopped at the angular position shown in FIG. 2.

The angular position of the printing drum 1 is detected with the encoder and the pulse counting means at all times. When the clamping means 52 on the printing drum 1 comes top as shown in FIG. 2, an A detection sensor (not shown) detects an A detection position. In the embodiment, the angular position of the printing drum 1 is indicated, with the A detection position as 0°.

The original 11 is read when the reading pulse motor 13 is rotated clockwise (or in the forward direction). When the motor 13 is rotated clockwise (in the forward direction), the original handling roller 21 is turned clockwise, while the rotation of the motor 13 is transmitted through the gears 14 through 18 and the gears 23 through 25 to the original forwarding roller 26 to turn the latter 26. Thus, the original 11 is read with the reading means 64 (fixedly positioned) while being forwarded to the right in FIG. 2.

The writing operation is carried out with the thermal head 9 while the stencil sheet 3 is being conveyed to the right with the platen roller 10 which is turned in association with the rotation of the writing pulse motor 55.

For a predetermined period of time from the start of the writing operation, the clutch means 58 shown in FIG. 4 is activated (on), so that the discharge rollers 29 are turned by the rotation of the writing pulse motor 55, to move the stencil sheet 3 a predetermined distance towards the printing drum 1. Since the peripheral speed of the discharge rollers 29 is lower than that of the platen roller 10, the stencil sheet 3 is gradually slackened while those rollers 10 and 29 are being turned.

The reading operation end the writing operation are each carried out with the original 11 and the stencil sheet 3 being continuously moved.

In winding the stencil sheet on the printing drum 1 which has been thermally processed in the writing operation, the control means 62 controls the rotation of the printing drum 1 stepwise. That is, the printing drum 1 is turned intermittently in several steps (as described later).

When compared with the conventional system that first a printing stencil is fully made of the stencil sheet, and then the printing stencil is wound on the printing drum, the above-described system that, in winding the stencil sheet on the printing drum which has been thermally processed to obtain the printing stencil, the printing drum is turned intermittently in several steps is advantageous in the following points: The waiting time which elapses from the time instant that the stencil making operation starts until the stencil winding operation is ended, can be decreased. Furthermore, irrespective of the stencil making speed, the stencil can be steadily wound on the printing drum at all times. In addition, the stroke of the movable guide means to absorb the slackening of the stencil, and the space for receiving the slackened part of the stencil sheet can be decreased; that is, the printing machine can be reduced in size and in weigh as much.

As the writing operation advances, the front end of the stencil sheet 3, being conveyed through stationary guide means 32 and the movable guide 8, reaches the nipping regions of the discharge rollers 29 and the driven rollers 30.

As the discharge rollers 29 turn, the front end of the stencil sheet 3 reaches the top of the clamping; means 52 through stationary guide 33, and at the same time the clutch means 58 is deactivated (turned off) (the time instant t3).

As a result, the discharge rollers 29 are stopped, and soon or later the clamping means 52 is opened and closed (the clamp motor is turned on and off) to lock the front end portions of the stencil sheet 3 to the printing drum 1.

In this operation, the stencil sheet 3 is still kept thermally perforated by the thermal head 9 with the platen roller 10 being rotated. However, since the discharge rollers 29 have been stopped, the stencil sheet 3 is not forwarded to the printing drum 1, thus being slackened between the platen roller 10 (serving as the feed roller in this case) and the discharge rollers 29.

Figure 10:
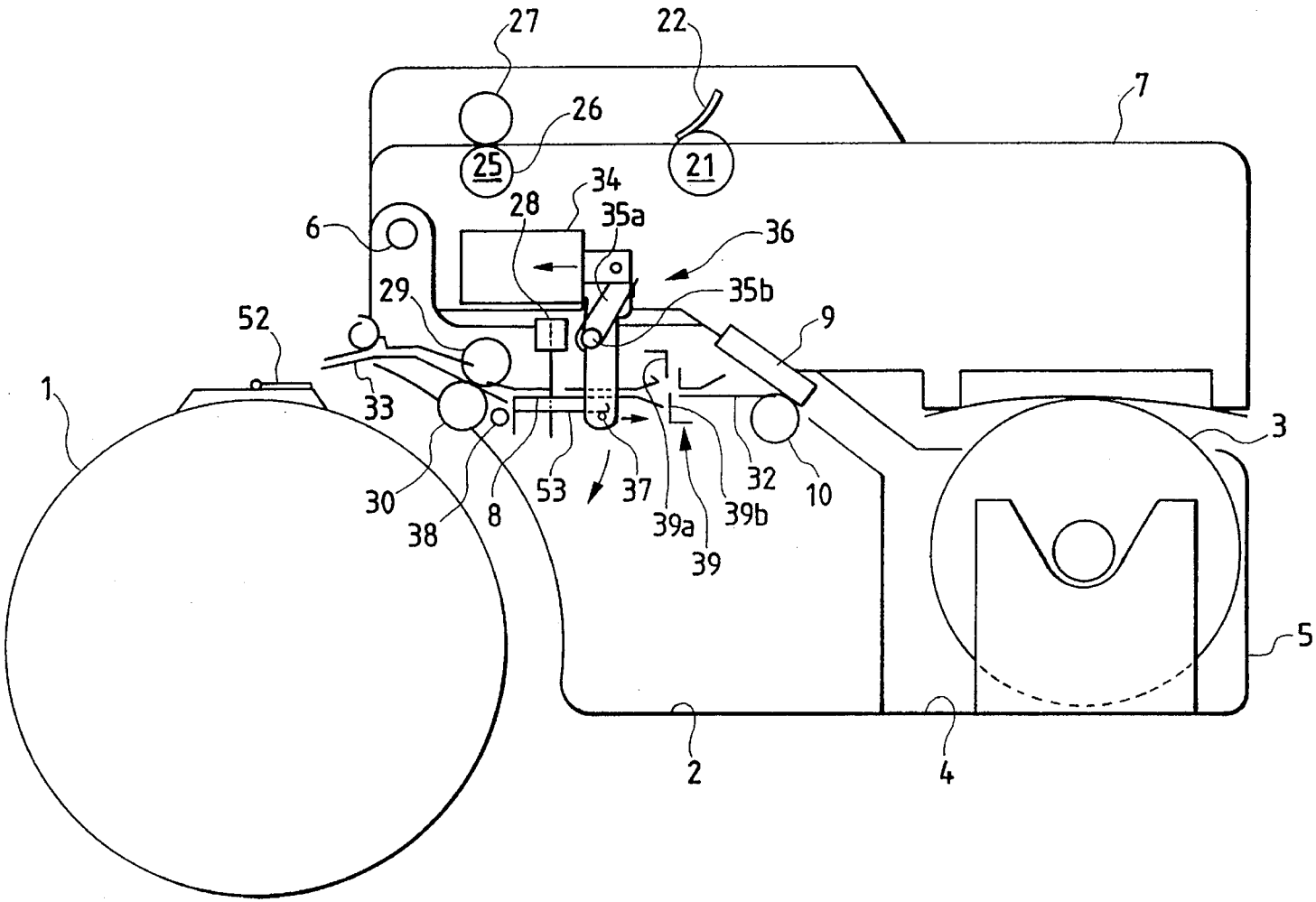
FIG. 10 is a diagram showing a movable-guide-means fixing mechanism in the rotary printing machine.

While the stencil sheet 3 is fixed with the clamping means 52 on the printing drum 1, the holding means 36 of the movable guide means 8 which is locked as shown in FIG. 10 is released. PIG. 10 shows the opposite side of the printing machine shown in FIG. 1.

When the writing pulse motor 55 starting at the time instant t1 rotates as much as a predetermined number of pulses (the time instant t2), the movable guide solenoid 34 shown in FIG. 10 is energized (on) for a predetermined period of time.

When the solenoid 34 is energized, a link 35*a* is turned counterclockwise about a shaft 35*b*. As a result, a pin 37 embedded in the link 35*a* is disengaged from the hook 53 of the movable guide 8, whereby the movable guide 8 is pivoted about the shaft 38 by its own weight (which is the energizing force of energizing means in the embodiment) so as to absorb the slackening of the stencil sheet 3 between the platen roller 10 and the discharge rollers 29.

In this case, since the gear 66 of the damper 65 is engaged with the sector gear 44 which is integral with the movable guide 8 through the shaft 38, the movable guide 8 is slowly swung. This feature eliminates a difficulty that the stencil sheet 3 in the movable guide 8 is strongly pulled towards the printing drum 1 whale being thermally perforated by the thermal head 9, or vibration is shockingly applied to the thermal head 9 through the stencil sheet 3. That is, the stencil sheet is smoothly processed with the thermal head 9.

When the movable guide solenoid 34 is deenergized (off), and the pin 37 is returned to its position shown in FIG. 10, the slackening of the stencil sheet has been further advanced, and accordingly the pivoting of the movable guide means 8 has also been further advanced towards the holding position. Hence, the pin 37 is engaged with the hook 53, to limit the pivoting of the movable guide 8.

In the writing operation, the stencil sheet 3 which has been thermally perforated by the thermal head 9 is forwarded by the platen roller 10 which is continuously rotated, so that the stencil sheet 3 is further slackened between the platen roller 10 and the discharge rollers 29 which have been stopped.

In response to the slackening of the stencil sheet 3, the movable guide means 8 is swung counterclockwise about the shaft 38 by its own weight as shown in FIG. 5 (clockwise in FIG. 10).

In this operation, the stencil sheet 3 is being guided by the movable guide 8 which includes a pair of upper and lower guides 8*a* and 8*b*.

Hence, the stencil sheet 3 is smoothly guided in the direction in which the movable guide 8 pivots. The pivoting of the movable guide 8 is indicated as a locus in FIG. 9.

The movable guide solenoid 34 is energized (on) when, after a predetermined period of time passes from the time instant the writing operation is started by driving the writing pulse motor 55, a predetermined number of pulses are applied to the writing pulse motor (the time instant t2).

The writing operation is further advanced to the extent that the slackening of the stencil sheet 3 cannot be absorbed by the swinging of the movable guide 8. Even after this, the stencil sheet 3, being forwarded by the platen roller 10, is slackened and held in the holding chamber 2 (as indicated by the two-dot chain line in FIG. 5).

At the time instant t4 the number of pulses applied to the writing pulse motor 55 reaches a predetermined value after the start of the writing operation, the printing drum 1 is turned a predetermined angle (for instance 45° ) by the main motor so that the stencil sheet which has been thermally perforated by the thermal head and held slackened in the holding chamber 2 is wound on the printing drum 1.

In this case, the clutch means 58 is inoperative, and therefore the discharge rollers 29 can be freely turned following the movement of the stencil sheet 3 being wound. Hence, the stencil sheet 3 is lightly forwarded as much as the angle of rotation of the printing drum 1.

As the printing drum 1 is further turned to absorb the slackening of the stencil sheet 3 in the holding chamber 2, the movable guide 8 is swung back to the return position (shown in FIG. 2) against its own weight by the tensile force of the stencil sheet 3. However, in this case, since the angle of rotation of the printing drum 1 is determined to the extent that all the slackened the stencil sheet 3 in the holding chamber is not wound on the printing drum 1, the movable guide 8 is returned to a position which is slightly before the position where the hook 53 is engaged with the pin 37 (the time instant t5).

Thereafter, when the stencil sheet 3 is sent into the holding chamber 2 through the platen roller 10 while the printing drum i is being temporarily stopped, the movable guide 8 is turned counterclockwise (in FIG. 5) by its own weight to absorb the slackening of the stencil sheet 3.

Thereafter, the above-described operation is performed several times. In the embodiment, it is performed further three times; that is, the main motor is driven to turn the printing drum 45° to 90°, 90° to 150°, and 150° to 360°.

When, after the completion of the writing operation (the time instant t6), the part of the stencil sheet 3 which has been thermally processed with the thermal head 9 passes through the cutter 39 a predetermined distance, the writing pulse motor 55 is stopped, and the cutter 39 is operated to separate the part thus thermally processed from the stencil sheet 3 (the time instant t7); that is, a printing stencil is obtained.

The cutter 39, as shown in FIG. 5, includes a stationary lower blade 39*b*, and a movable upper blade 39*a*. With respect to the lower blade 39*b*, the upper blade 39*a* are moved up and down with the operating timing of a cutter motor shown in FIG. 9, to cut the stencil sheet 3.

As a result, the cut end of the stencil sheet 3 is left in the holding chamber 2.

Thereafter, at the time instant t8, the printing drum 1 is turned through the remaining angle (150° to 360°), so that the printing stencil 3 held in the holding chamber 2 is, in its entirety, wound on the printing drum 1.

When, after the stencil winding operation is started with the printing drum at the A detection position, the printing drum 1 is turned to the next A detection position (the time instant t9), the reading pulse motor 13 is turned in the opposite direction; that is, it is turned counterclockwise in FIG. 2.

As a result, the gear 17 is disengaged from the gear 18, and then engaged with the gear 40. That is, the reverse rotation of the reading pulse motor 13 is transmitted to the gear The rotation of the gear 40 is transmitted through the gears 41 through 43 to the sector gear 44 to turn the gear 44 clockwise in FIG. 2. In this ease, since the movable guide means 8 is coupled to the sector gear 44 through the shaft 38, the movable guide means 8 starts to return to the original position shown in FIG. 2 as the sector gear 44 turns.

When the movable guide 8 is returned to the original position, the hook 53 is engaged with the pib 37 which has been returned to its original position, and the movable guide 8 is locked at the standby position. At the same time, the returning of the movable guide 8 is detected by a movable guide sensor (indicated only in FIG. 9) (the time instant t10).

When the movable guide 8 is returned to the standby position, the reading pulse motor 13 is stopped. At the same time, the writing pulse motor 55 is turned through an angle corresponding to a predetermined number of pulses, so that the front end portion of the stencil sheet 3 is sent in the movable guide 8 so as to be located just before the aforementioned shutter for the next stencil making operation. Thus the stencil making operation has been accomplished.

When, after the stencil winding operation is started with the printing drum at the A detection position, the printing drum is at an angular position of 270° in the third turn as indicated in FIG. 9, the printing drum 1 is finally stopped, thus being ready for the printing operation. A first printing operation (or test printing operation) is carried out with the rotation of the drum from the rear half of the first turn to the front half of the second turn.

Thereafter, one print is formed every time the printing drum 1 makes one revolution with its angular position of 270° as a reference angular position.

In the above-described embodiment, the movable guide solenoid 34 is energized (on) to disengage the pin 37 from the hook 53, and, immediately when the pin 37 is disengaged from the hook 53, it is deenergized (off); that is, the operating period of the movable guide solenoid 34 is shortened, so that the power consumption is decreased as much; however, the invention is not limited thereto or thereby. That is, the printing machine may be so designed that the movable guide solenoid is kept energized (on) until the stencil winding operation is accomplished.

In this case, the writing pulse motor 55 is turned in the reverse direction, so that the movable guide solenoid is deenergized (off) immediately before or immediately after the movable guide means 8 returns to the standby position. Hence, in the stencil winding operation, the stencil sheet 3 is stretched tight between the platen roller 10 and the discharge rollers 29, and even if the guides of the movable guide means are horizontal, the pin 37 is not engaged with the hook 53. Hence, the movable guide 8 can be swung plural times.

In the above-described embodiment, the movable guide 8 is swung about the one shaft. However, its movement in the direction perpendicular to the direction in which the stencil sheet 3 is moved by the platen rollers 10 and the discharge rollers 29 may be so modified that it is made linearly along the guide.

Furthermore, in the above-described embodiment, the movable guide 8 includes the upper and lower guides 8*a* and 8*b*; however, the movable guide means 8 may be made up of only the upper guide 8*a* (without the lower guide 8*b*).

Figure 11A:
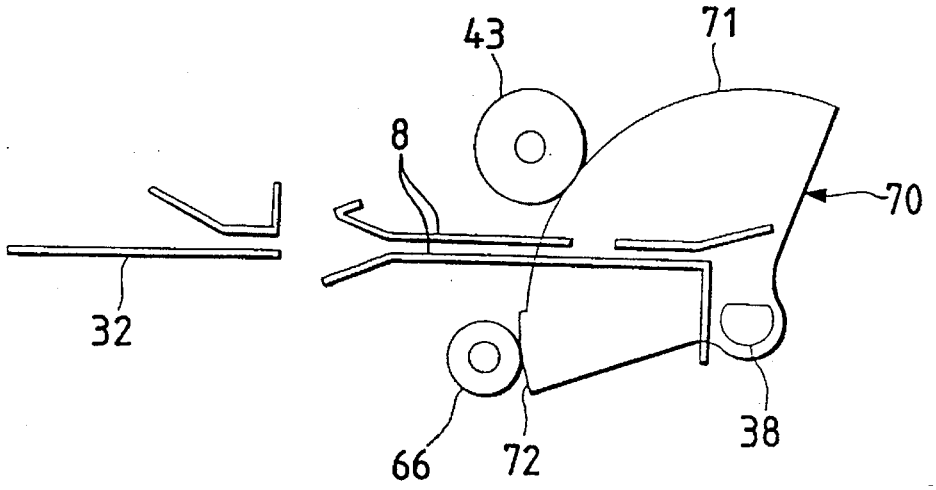
FIGS. 11(*a*) and 11(*b*) are diagrams showing another example of the damping mechanism in the rotary printing machine.
Figure 11B:
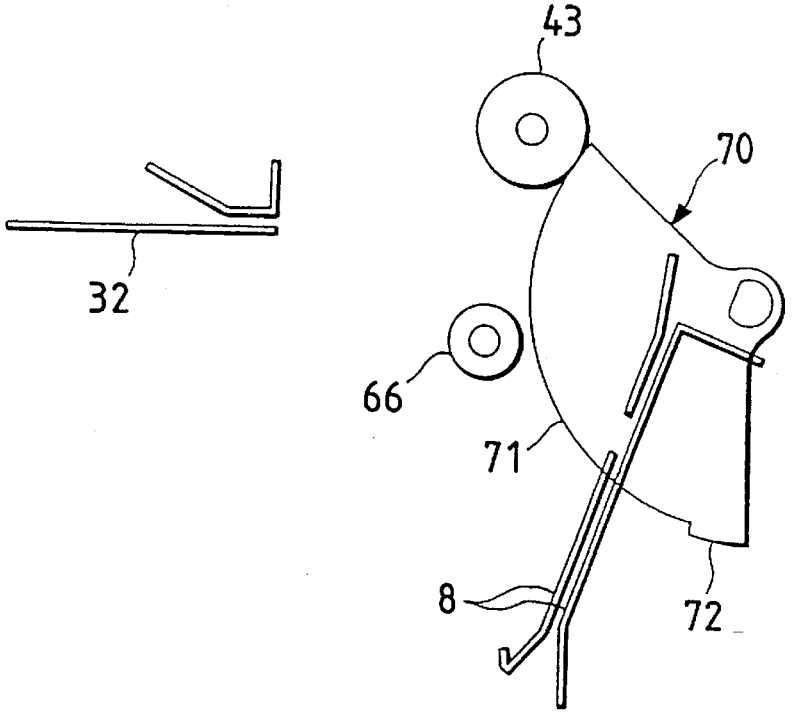

FIGS. 11(*a*) and 11(*b*) show another example of the damping mechanism. The damping mechanism includes a sector gear, and a damper. FIG. 11(*a*) shows the movable guide 8 which is located at the original position.

The sector gear 70 has two circular arcs different in radius on which gears 71 and 72 are formed in such a manner that the gear 71 is engaged with the gar 43, and the gear 72 is engaged with the gear 66 of the damper 65. While the movable guide 8 is being pivoted from the standby position towards the holding position, as shown in FIG. 11(*b*) the gear 72 is disengaged from the gear 66. Thereafter, until the sector gear 44 is forcibly returned to the standby position (FIG. 10) by the reverse rotation of the reading pulse motor 13, those gears 72 and 66 are kept prevented from being engaged with each other again, so that in swinging the movable guide 8, the load given thereto is reduced.

As is apparent from the above description, the rotary stencil printing machine has the following effects or merits:

(1) The rotary stencil printing machine of the invention comprises: the movable guide means which is movable between the standby position and the holding position which are spaced away from each other in the direction perpendicular to the surface of the stencil sheet located between the stencil making means and the printing drum, the movable guide means moving from the standby position to the holding position to substantially lengthen the stencil conveying path between the stencil making means and the clamping means; the urging means for urging the movable guide means towards the holding position; and the holding means which holds the movable guide means at the standby position against the urging means, and, after the stencil sheet is held on the side of the printing drum rather than on the side of the movable guide means, releases the movable guide means.

Hence, when held between the stencil making means and the printing drum, the stencil sheet is slackened only in one direction, and the slackening thereof is absorbed. In winding the stencil sheet on the printing drum, the stencil sheet is lightly stretched by the movable guide means. Thus, the printing machine is free from the difficulty that, when slackened, the stencil sheet is damaged, being irregularly or acutely bent. In addition, the stencil sheet is uniformly wound on the printing drum without forming creases.

(2) In winding the stencil sheet on the printing drum which has been perforated by the thermal head, the printing drum is turned in several steps, while being intermittently paused. This feature makes it possible to miniaturize the movable guide means adapted to absorb the slackening of the stencil sheet, and to decrease the volume of the holding chamber adapted to temporarily hold the slackened stencil sheet, and accordingly to reduce the size and weight of the printing machine.

(3) In reading the original with the reading means, the original reading motor is turned in the opposite direction after the stencil sheet has been wound on the printing drum, to return the movable guide means to the standby position. This fact contributes to a reduction in the manufacturing cost of the printing machine.

(4) At least when the movable guide means is initially moved from the standby position to the holding position, the damping means acts to decrease the force of movement of the movable guide means. Hence, the movable guide means is never abruptly moved even when it is released from the holding means. That is, the rotary stencil printing machine is free from the difficulty that, while being thermally processed with the thermal head, the stencil sheet is momentarily Jerked, and the picture formed on it is spoiled.

What is claimed is:

1. A rotary stencil printing machine in which a printing stencil is obtained from a stencil sheet, said rotary stencil printing machine comprising:

stencil making means for processing the stencil sheet to obtain the printing stencil;

a printing drum having an outer cylindrical surface and clamping means which clamps the front end portion of the stencil sheet thus processed by said stencil making means, said printing drum being turned with the front end portion of the stencil sheet clamped with said clamping means to wind the stencil sheet on said outer cylindrical surface thereof;

conveying means for conveying the stencil sheet, which has been processed by said stencil making means, towards said printing drum;

movable guide means which is movable between a standby position and a holding position which are spaced away from each other in a direction perpendicular to the surface of the stencil sheet located between said stencil making means and said printing drum, said movable guide means moving from said standby position to said holding position, for lengthening a stencil conveying path between said stencil making means and said clamping means;

urging means for urging said movable guide means towards said holding position; and holding means for holding said movable guide means at said standby position against said urging means, and for, after the stencil sheet is held on the side of said printing drum rather than on the side of said movable guide means, releasing said movable guide means.

2. A rotary stencil printing machine according to claim 1, wherein said movable guide means has guide surfaces for both sides of the stencil sheet, to cause the stencil sheet to follow the movement of said movable guide means between said standby position and said holding position.

3. A rotary stencil printing machine according to claim 1, wherein the urging of said movable guide means by said urging means attributes to the weight of said movable guide means.

4. A rotary stencil printing machine according to claim 1, further comprising:

returning means for, after the stencil sheet is wound on said printing drum, returning said movable guide means against said urging means.

5. A rotary stencil printing machine according to claim 4, further comprising:

original reading means for reading an original to be printed; and a reading motor which, when the original is read with said original reading means, is rotated in one direction to move said original reading means and the original with respect to each other, and, after the stencil sheet is wound on said printing drum, is rotated in the opposite direction through a predetermined angle, wherein said returning means operating to return said movable guide means to the standby position in association with the rotation of said reading motor in the opposite direction.

6. A rotary stencil printing machine according to claim 1, wherein said holding means comprises:

a link which has an engaging portion which is engaged with said movable guide means, and is swingably supported on a machine frame; and an electro-magnetic solenoid for controlling the swinging of said link.

7. A rotary stencil printing machine according to claim 1, wherein, while a stencil making operation is being carried out said printing drum is turned in plural steps having intermittent pausing to wind the stencil sheet on said printing drum.

8. A rotary stencil printing machine according to claim 1, further comprising:

damping means which, at least when said movable guide means is initially moved from the standby position to the holding position, resists said movable guide means to decrease the force of movement of the movable guide means which is urged by said urging means.

* * * * *